United States Patent [19]

Wikstrom

[11] 4,208,165

[45] Jun. 17, 1980

[54] COMPOSITE STATOR TYPE TURBO-MACHINE

[75] Inventor: Rolf Wikstrom, Finspong, Sweden

[73] Assignee: Stal-Laval Turbin AB, Finspang, Sweden

[21] Appl. No.: 922,254

[22] Filed: Jul. 5, 1978

[30] Foreign Application Priority Data

Jul. 12, 1977 [SE] Sweden ..... 7708075

[51] Int. Cl.[2] ..... F01D 25/24; F01D 9/02

[52] U.S. Cl. ..... 415/138; 415/199.5; 415/218

[58] Field of Search ..... 415/136, 137, 138, 139, 415/199.5, 218, 108

[56] References Cited

U.S. PATENT DOCUMENTS

| | | | |
|---|---|---|---|
| 1,666,625 | 4/1928 | Losel | 415/108 |
| 1,745,429 | 2/1930 | Lysholm | 415/199.5 X |

FOREIGN PATENT DOCUMENTS

| | | | |
|---|---|---|---|
| 1055548 | 4/1959 | Fed. Rep. of Germany | 415/108 |
| 896166 | 2/1945 | France | 415/139 |
| 262784 | 5/1927 | United Kingdom | 415/199.5 |

*Primary Examiner*—Leonard E. Smith

*Attorney, Agent, or Firm*—Pollock, Vande Sande & Priddy

[57] ABSTRACT

A novel turbo-machine of the axial type including a rotor assembly supported within a stator housing which includes a plurality of partition wall sections positioned adjacent one another, with each pair of sections extending on opposite sides of a rotor blade attached to the rotor assembly. Each of the partition sections is formed of a pair of similarly-shaped members, with adjacent pairs of members being rotated a specific angle prior to joining all of the pairs of each other via fasteners extending therethrough, with the plurality of joined sections then attached to the stator housing in a manner which compensates for both axial and radial thermal expansion during operation.

8 Claims, 2 Drawing Figures

Fig. 1
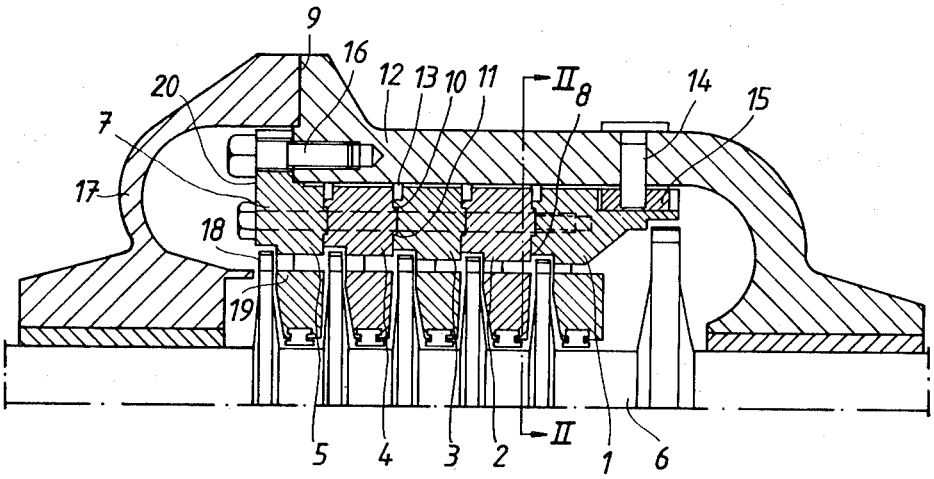
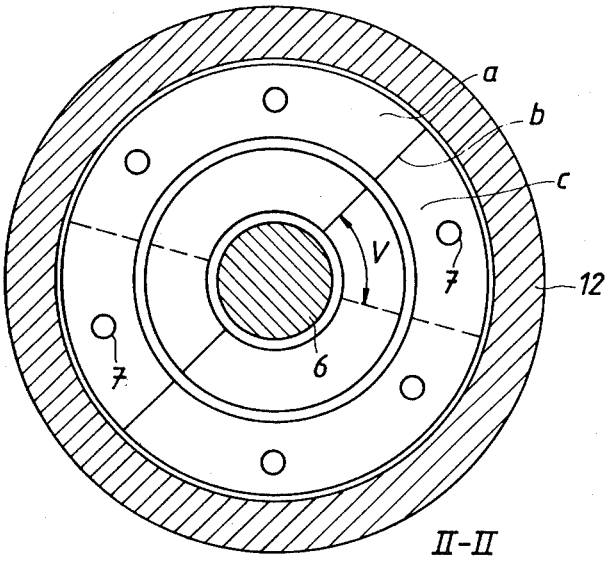
Fig. 2

COMPOSITE STATOR TYPE TURBO-MACHINE

BACKGROUND OF THE INVENTION

The present invention relates generally to a turbo-machine of the axial type, which includes a rotor assembly supported within a stator housing. In particular, the present invention is directed to a stator assembly including a plurality of partitioned wall sections which are pre-assembled and then attached as a single unit to the stator housing.

Conventional turbine stator assemblies generally include an integral wall structure which is difficult to assemble and tends to become positionally misaligned due to thermal expansion during operation of the turbine. Misaligned stator walls may contact and extensively damage the rotor blade assembly of the turbine, leading to costly repairs as well as inefficient operation.

As will be discussed in detail hereinafter, applicant's new and useful invention solves the thermal expansion problems confronting prior art assemblies, while at the same time providing a compact turbine structure capable of maintaining proper alignment between stator and rotor during both axial and radial expansion of the turbine assembly.

OBJECTS OF THE PRESENT INVENTION

An object of the present invention is to provide a novel turbo-machine assembly including a plurality of partition wall sections which may be joined together prior to attachment with the stator housing.

A further object of the present invention is to provide a plurality of wall partition sections each of which are formed of two similarly-shaped members with the pairs of members of adjacent partition wall sections being rotated relative to each other to provide for easy assembly.

Another object of the present invention is to provide a turbo-machine of the axial type which is compact in structure and which maintains proper alignment during thermal expansion of the heated structure.

These and other objects of the invention will become apparent from a reading of the following specification and claims, together with the accompanying drawings, wherein similar elements are referred to and are indicated by similar reference numerals.

BRIEF DESCRIPTION OF THE DRAWINGS

The present invention can be best understood with reference to the accompanying drawings wherein:

FIG. 1 shows an axial section through a turbine formed according to a preferred embodiment of the invention; and FIG. 2 shows a cross-sectional view of the preferred embodiment taken along section lines II—II of FIG. 1.

DETAILED DESCRIPTION OF A PREFERRED EMBODIMENT

Referring to the drawings, and FIG. 1 in particular, a preferred embodiment of the turbo-machine is shown in axial section. The turbo-machine comprises a rotor 6 which is rotatably supported within a stator housing 12. Stator housing 12 includes an integral end wall portion forming a first bearing for rotor 6, while a separate end wall 17 is attached to housing 12 at an end section 9 and forms a second, separate bearing for rotor 6.

Stator housing 12 further includes a number of partition wall sections indicated at 1–5 which are attached to one another and to stator housing 12 in a manner to be described hereafter. Each of the partition wall sections 1–5 includes a guide vane 19, with a separate blade 18 extending from rotor 6 between each pair of adjacent guide vanes 19, as shown in FIG. 1. Partition wall sections 1–5 are formed with mating recesses and edges 10, 11 to allow for proper alignment of adjacent sections during assembly. In addition, a groove 8 is formed in each of the partition wall sections 1–5 to prevent contact between adjacent sections and a tip of blade 18 extending therebetween.

Each of the partition wall sections 1–5 is divided into two portions or members designated a, c, respectively, by a diametrical section b extending therethrough. During assembly the dividing section b of each two-part section is rotated on angle v relative to adjacent sections on either side, wherein portins or members a, c of adjacent sections overlap each other. A plurality of holes formed through each of the adjacent sections are brought into alignment when the portions or members have been properly rotated to allow a plurality of axial bolts 7 to extend through and fixedly join all the sections into a unitary structure.

Partition wall section 5 is provided with a flange 20, which is fixedly attached to stator housing 12 via a plurality of bolts 16 extending through aligned apertures formed in flange 20 and housing 12. Partition wall section 1 is provided with at least three recesses, with each recess including a fitting piece 15 positioned therein and secured to housing 12 via an adjustable bolt 14. The novel placement of bolts 14, 16 and the novel partition wall structure allows both axial and radial expansion of the stator assembly while preventing misalignment of partition wall sections 1–5 relative to the rotor assembly.

A plurality of sealing rings 13 may be positioned in grooves formed between adjacent sections 1–4 and stator housing 12. Each ring 13 may be formed from a plurality of ring sections positioned end to end, with each ring 13 being preferably formed from a resilient material to provide maximum sealing between housing 12 and sections 1–5, respectively.

The present invention is not limkited to the above described embodiment, but is limited only by the scope of the following claims.

What is claimed is:

1. A turbo-machine of the type comprising:

a rotor assembly including a plurality of spaced rotor blades extending from a rotor shaft;

a stator assembly including a stator housing surrounding said rotor assembly, with portions of said stator housing forming bearing contact with said rotor shaft;

a plurality of partition wall sections positioned adjacent one another within said stator housing, with each partition wall section including a plurality of apertures extending completely therethrough;

each partition wall section being formed from a pair of substantially similarly-shaped members having confronting edge surfaces contacting one another along a single plane extending diametrically through said respective partition wall section;

with each respective pair of confronting edge surfaces being angularly offset a predetermined amount compared to confronting edge surfaces of an adjacently disposed pair of similarly-shaped members, to axially align with one another the plurality of apertures extending through said similarly-shaped partition wall members;

fastening means extending through said axially aligned plurality of apertures for joining said similarly-shaped members into a united assembly; and further means attaching and united assembly to said stator housing for allowing both axial and radial thermal expansion of said united assembly relative to said stator housing during operation of said turbo-machine.

2. A turbo-machine according to claim 1, wherein each of said partition wall sections includes a guide vane extending between adjacent rotor blades;

and each of said wall sections further includes a groove formed in a surface portion adjacent a tip of said rotor blade to prevent contact therebetween.

3. A turbo-machine according to claim 1, wherein each pair of adjacent partition wall sections includes aligning means for mutually centering said partition wall sections relative to each other.

4. A turbo-machine according to claim 3, wherein said aligning means comprises a recess formed in one of said partition wall sections and a mating edge extending from said adjacent partition wall section and positionable within said recess to properly align said adjacent partition wall sections.

5. A turbo-machine according to claim 1, wherein at least one sealing ring is positioned in a groove formed between adjacent partition wall sections and said stator housing, with said sealing ring being formed of resilient material.

6. A machine according to claim 5, wherein a plurality of sealing rings are positioned between each pair of adjacent partition wall sections and said stator housing, with at least one of said sealing rings being formed from a plurality of separate ring segments positioned end to end.

7. A turbo-machine according to claim 1, wherein said further means comprises a first plurality of bolts extending axially through a further plurality of apertures formed through a first partition wall section and into said stator housing; and said further means also comprising a further plurality of bolts extending radially between a second partition wall section and said stator housing.

8. A turbo-machine according to claim 7 wherein said first and second partition wall sections are positioned on opposite axial ends of said united wall section assembly.

* * * * *